US012252952B2

(12) United States Patent
Least et al.

(10) Patent No.: US 12,252,952 B2
(45) Date of Patent: Mar. 18, 2025

(54) EXPANDABLE METAL FOR NON-COMPLIANT AREAS BETWEEN SCREENS

(71) Applicant: Halliburton Energy Services, Inc., Houston, TX (US)

(72) Inventors: Brandon T. Least, Carrollton, TX (US); Stephen Michael Greci, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/309,456

(22) Filed: Apr. 28, 2023

(65) Prior Publication Data

US 2024/0360737 A1 Oct. 31, 2024

(51) Int. Cl.
*E21B 33/12* (2006.01)

(52) U.S. Cl.
CPC ..... *E21B 33/1208* (2013.01)

(58) Field of Classification Search
CPC ..... E21B 33/1208
See application file for complete search history.

(56) References Cited

U.S. PATENT DOCUMENTS 4,379,561 A * 4/1983 Nelson ..... E21B 23/06 116/106
6,581,682 B1 * 6/2003 Parent ..... E21B 33/1243 166/119
6,719,064 B2 4/2004 Price-Smith et al.
7,040,404 B2 5/2006 Brothers et al.
7,228,915 B2 * 6/2007 Thomson ..... E21B 33/1208 277/944
7,997,338 B2 * 8/2011 Foster ..... E21B 33/1208 166/195
8,443,888 B2 * 5/2013 Coronado ..... E21B 43/12 166/305.1
9,617,821 B2 4/2017 Solhaug
10,494,893 B2 * 12/2019 Tse ..... E21B 33/1208
11,047,203 B2 6/2021 Fripp et al.
11,299,955 B2 4/2022 Fripp et al.
11,359,448 B2 6/2022 Fripp et al.
11,519,239 B2 12/2022 Greci et al.
11,891,867 B2 * 2/2024 Fripp ..... E21B 23/0411
2003/0196820 A1 10/2003 Patel
(Continued)

FOREIGN PATENT DOCUMENTS

EP 2836672 1/2019
NL 20211419 11/2021

OTHER PUBLICATIONS

"PCT Application No. PCT/US2023/066442, International Search Report and Written Opinion", Jan. 26, 2024, 10 pages.
(Continued)

*Primary Examiner* — Steven A MacDonald
(74) *Attorney, Agent, or Firm* — DeLizio, Peacock, Lewin & Guerra, LLP

(57) ABSTRACT

In some implementations, a clamshell packer for use in a wellbore proximate to a subsurface formation comprises an expandable non-elastomeric material and is configured to annularly envelop a non-compliant portion of a tubular in the wellbore, the non-compliant portion between one or more expandable screens.

20 Claims, 10 Drawing Sheets

(56) References Cited

U.S. PATENT DOCUMENTS

2003/0221829 A1* 12/2003 Patel ..... E21B 43/045 166/278
2004/0174017 A1* 9/2004 Brill ..... F16L 15/00 285/333
2005/0199401 A1* 9/2005 Patel ..... E21B 33/1277 166/387
2005/0217847 A1* 10/2005 Jones ..... E21B 43/103 166/278
2008/0093086 A1* 4/2008 Courville ..... E21B 33/1216 166/134
2008/0210418 A1 9/2008 Knippa et al.
2009/0078405 A1* 3/2009 Moore ..... E21B 17/20 166/85.4
2009/0179383 A1* 7/2009 Koloy ..... E21B 33/1216 277/340
2009/0200043 A1* 8/2009 Olinger ..... E21B 33/1208 166/387
2010/0230094 A1* 9/2010 Foster ..... E21B 33/1208 166/179
2010/0294484 A1* 11/2010 Castillo ..... E21B 33/1208 228/115
2011/0036578 A1* 2/2011 Coronado ..... E21B 43/12 166/305.1
2011/0056706 A1* 3/2011 Brooks ..... E21B 33/1208 166/134
2011/0253393 A1 10/2011 Vaidya et al.
2013/0112408 A1* 5/2013 Oxtoby ..... E21B 33/12 166/250.17
2014/0083710 A1* 3/2014 Seyffert ..... E21B 17/085 166/345
2015/0285026 A1* 10/2015 Frazier ..... E21B 33/128 166/120
2017/0159400 A1* 6/2017 Corre ..... E21B 49/10
2020/0325749 A1* 10/2020 Fripp ..... E21B 33/10
2020/0362224 A1* 11/2020 Wellhoefer ..... E21B 33/1208
2020/0370391 A1* 11/2020 Fripp ..... E21B 33/1277
2021/0115750 A1 4/2021 Fripp et al.
2021/0123319 A1 4/2021 Greci et al.
2022/0243552 A1 8/2022 Least et al.
2022/0333716 A1 10/2022 Eldho et al.
2023/0135582 A1* 5/2023 Aldejani ..... E21B 33/127 166/387

OTHER PUBLICATIONS

"NO Application No. 2037226 Search Report", Aug. 7, 2024, 8 pages.

* cited by examiner

EXPANDABLE METAL FOR NON-COMPLIANT AREAS BETWEEN SCREENS

TECHNICAL FIELD

The disclosure generally relates to downhole tools for use in a wellbore formed in one or more subsurface formations, and in particular, expandable sealing elements that are configured to form and hold an annular seal within the wellbore.

BACKGROUND

Traditional packers and sealing elements may be used to form annular seals in wellbores and create zonal isolation. However, traditional packers may not be configured to seal non-compliant regions between expandable screens (e.g., expandable hydraulic screens) in the wellbore. These non-compliant regions may induce sand ingress that may result in hot spotting and eventual failure at the periphery of the expandable screens. Thus, a sealing system configured to form an annular seal against the wellbore in the non-compliant regions may mitigate potential damage to the expandable screens.

BRIEF DESCRIPTION OF THE DRAWINGS

Implementations of the disclosure may be better understood by referencing the accompanying drawings.

DESCRIPTION OF SOME EXAMPLE IMPLEMENTATIONS

The description that follows includes example systems, methods, techniques, and program flows that embody implementations of the disclosure. However, it is understood that this disclosure may be practiced without these specific details. In other instances, well-known instruction instances, protocols, structures, and techniques have not been shown in detail in order not to obfuscate the description.

Overview

A clamshell-style packer, as described below, may be used with one or more expandable screens in a wellbore. The clamshell packer may be clamped over a non-compliant region of a base pipe string (or other tubular) to which the expandable screens may not extend. The clamshell packer may prevent sand ingress into the wellbore at this non-compliant region. The clamshell packer may be coupled over a base pipe coupling, after the coupling is made up to the next base pipe, for example, at a surface of the wellbore by on-site personnel. The clamshell packer design allows the packer to be installed over the handling space previously used to make up the base pipe.

To provide zonal isolation in the wellbore, the clamshell packer may be comprised of a reactive, non-elastomeric material such as a metal or metal alloy which is configured to expand in the presence of brine. The expandable material may undergo a chemical reaction to form a reaction product (iron oxide, metal hydroxides, etc.) which may expand the clamshell packer in an annular space of the wellbore. Magnesium may be used to illustrate the volumetric expansion of the reactive metal as it undergoes reaction with the reaction-inducing fluid. The clamshell packer may expand to fill an adjacent, irregular void space such as an open-hole wellbore, thus providing a seal against the wellbore where the expandable screens typically may not reach.

Example Well System

Figure 1:
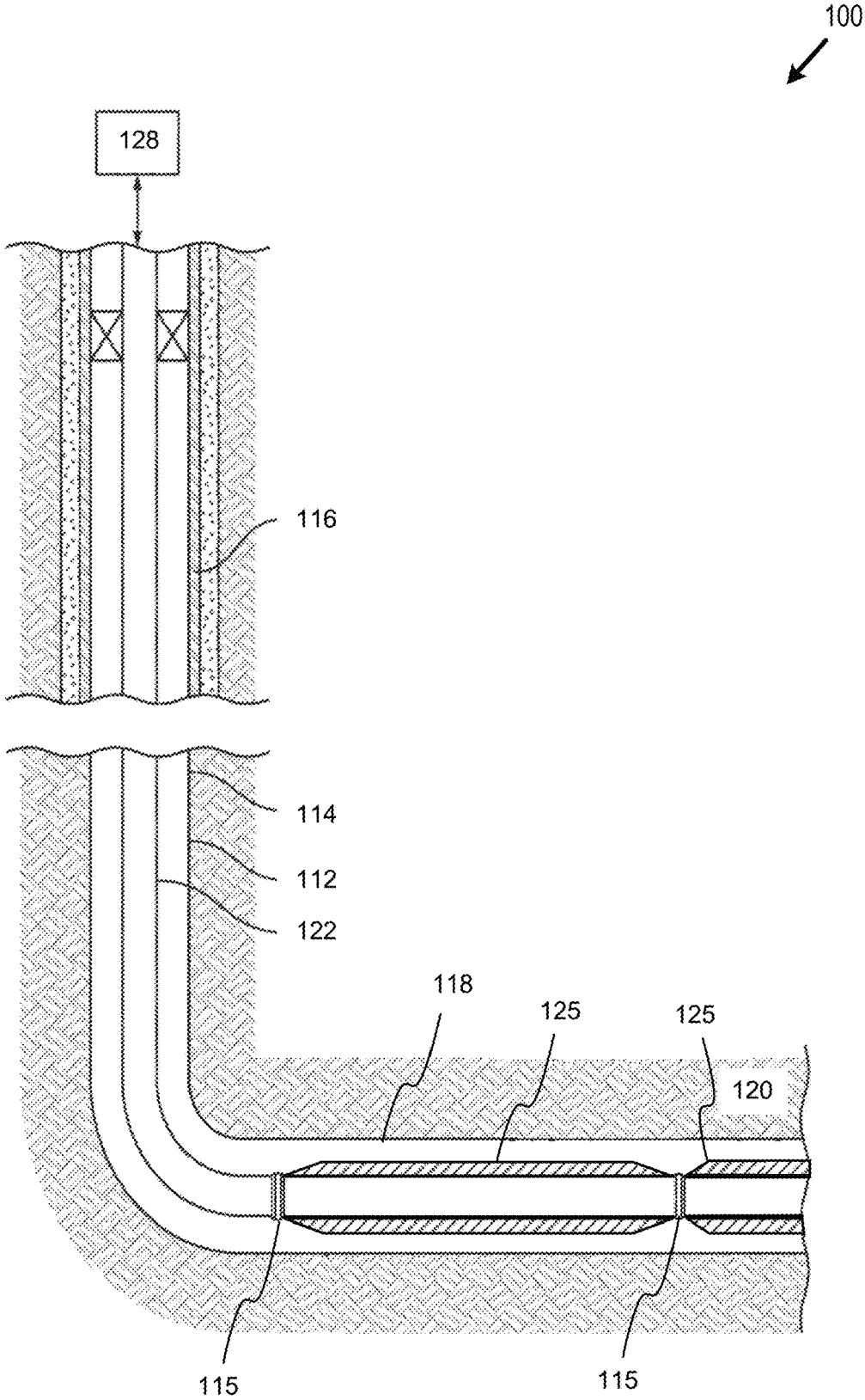
FIG. 1 is a cross-sectional diagram depicting an example well system comprising expandable screen systems, according to some implementations.

An example well system is now described. FIG. 1 is a cross-sectional diagram depicting an example well system comprising expandable screen systems, according to some implementations. A well system 100 may comprise a wellbore 112 which intersects a subsurface formation 120. The wellbore 112 may include a vertical section 114 (which is at least partially cemented with a casing string 116) and a horizontal section 118. The horizontal section 118 may be an open-hole section of the wellbore 112. Other wellbore configurations may also be suitable.

Positioned within the wellbore 112 and extending from the surface is a tubing string 122 which provides a conduit for formation fluids to travel from the subsurface formation 120 to the surface and for stimulation fluids to travel from the surface to the subsurface formation 120. The tubing string 122 may include one or more expandable screen systems 125. The expandable screen systems 125 may comprise sections of expandable metal screens used to mitigate the migration of unconsolidated reservoir sands or other solids into the wellbore 112. Thus, fluids from a reservoir within the subsurface formation 120 may be produced without introducing solids into the tubing string 122. In some implementations, the expandable screen systems 125 may be comprised of materials other than metal.

The expandable screen systems 125, as shown, are depicted in an inactive state to allow for deployment into the wellbore 112. However, the expandable screen system 125 may be actuated to expand and create a sealing interface with the wellbore 112. For example, the expandable screen system 125 may be actuated to expand via a hydraulic system, although various mechanical and electrical methods of actuation may be utilized.

The expandable screen systems 125 may be disposed on and span sections of the tubing string 122. At non-compliant sections of the tubing string 122, such as tubing joints comprising tubing couplings 115, the expandable screen systems 125 may not be present. These non-compliant sections, such as those at the tubing couplings 115, may introduce various production hazards. For example, sand migration from the subsurface formation 120 may occur over the tubing couplings 115 and other non-compliant regions where the screens are not emplaced for sand mitigation. At these non-compliant sections and proximate to the tubing couplings 115, a flow of fluids carrying sand and other abrasives from the subsurface formation 120 may be produced into the tubing string 122. The abrasives may induce hot spotting and erosion at the edges of the expandable screen systems 125, causing eventual failure of the expandable screen systems 125.

The expandable screen systems 125 may be configured to expand and eliminate an annular gap between the expandable screen systems 125 in their retracted state and a surface of a wellbore 112. The expandable screen systems 125, when expanded, may provide positive compliant sand control. Hydraulic activation pressure may radially extend the expandable screen systems 125 to conform to a geometry of the wellbore 112. The expandable screen systems 125 may be used in place of, for example, a gravel-pack or similar operation.

The well system 100 may further comprise surface equipment 128. The surface equipment 128 may comprise a wellhead, a choke, one or more production vessels, a power generator, a compressed air unit, and other items of equipment. In some implementations, the surface equipment 128 may be used to actuate and expand the expandable screen systems 125.

Example Assembly

Figure 2A:
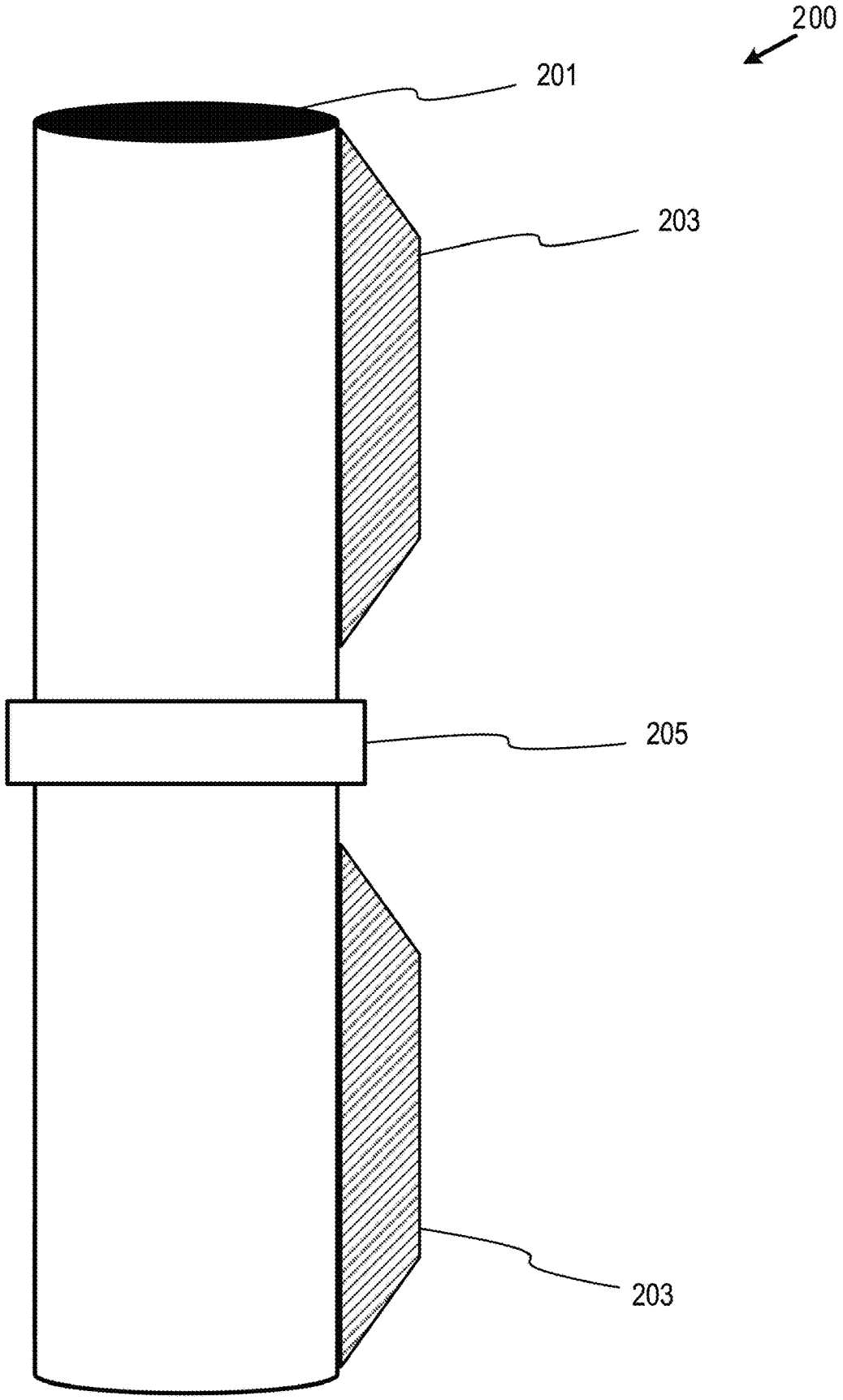
FIG. 2A is a first schematic diagram depicting an example tubing coupling between screen joints, according to some implementations.

FIG. 2A is a first schematic diagram 200 depicting an example tubing coupling between screen joints, according to some implementations. FIG. 2A may be described with reference to FIG. 1. A tubing string 201 may comprise a tubular and may include at least a coupling 205 between sections of tubing. On either side of the coupling 205 (and beyond a handling space typically between 6-36 inches in length) may reside a joint of an expandable screen 203. The expandable screens 203 may be similar to the expandable screen system 125 of FIG. 1. While depicted from a side-view, the expandable screens 203 may be annularly disposed around the tubing string 201. The tubing string 201, expandable screens 203, and tubing coupling 205 may not be depicted to scale. The schematic diagram 200 may depict the tubing string 201, screens 203, and coupling 205 at a rig setting or similar surface environment prior to being deployed into a wellbore. For example, a base pipe thread between the expandable screens 203 may be joined together at the coupling 205 by a rig floor crew, although other methods of assembly may be utilized.

Figure 2B:
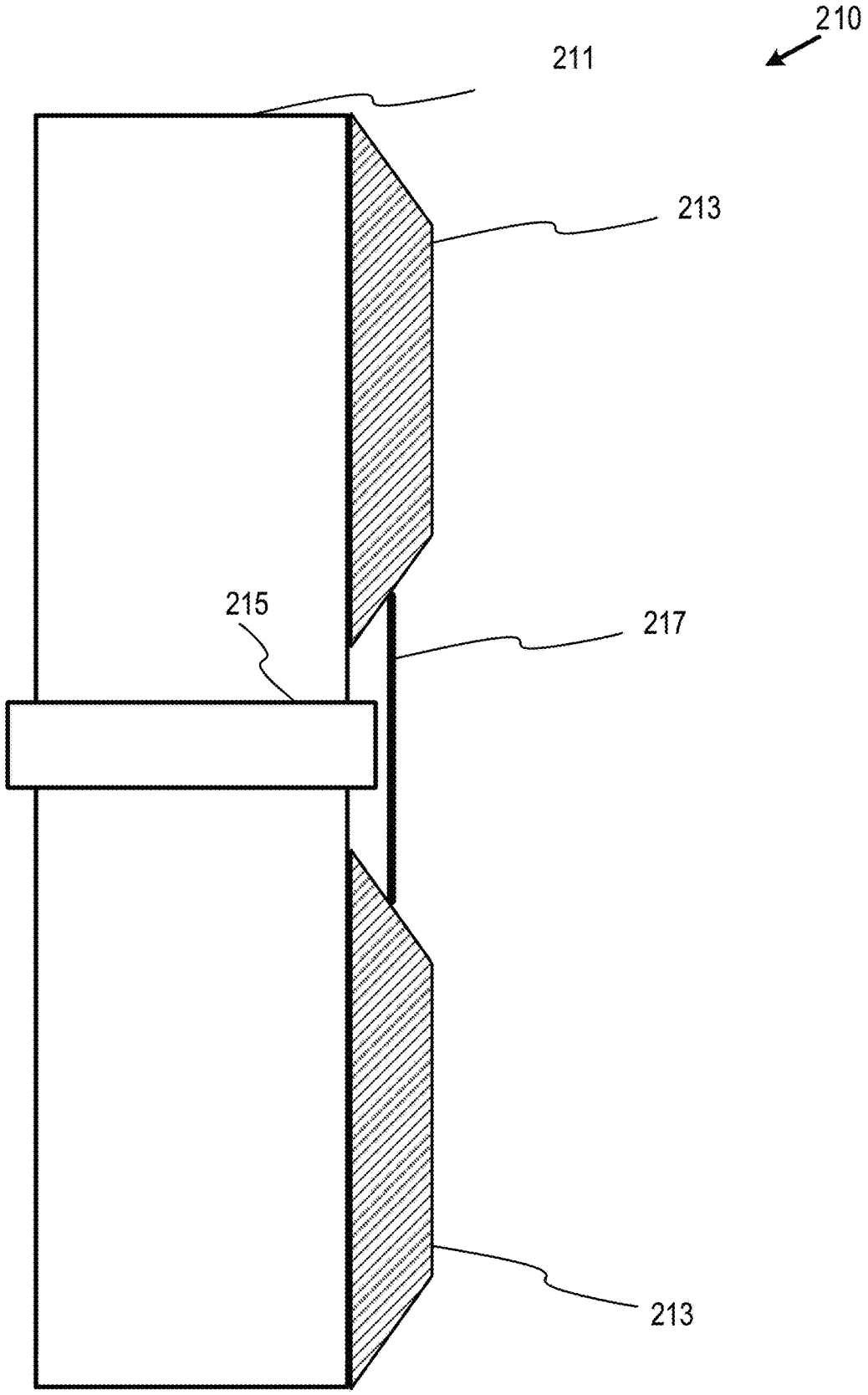
FIG. 2B is a second schematic diagram depicting an example tubing coupling between screen joints comprising a connection line, according to some implementations.

FIG. 2B is a second schematic diagram 210 depicting an example tubing coupling between screen joints comprising a connection line, according to some implementations. FIG. 2B may be described with reference to FIG. 2A. The schematic diagram 210 depicts a side-view of a tubing string 211. The tubing string 211 may be similar to the tubing string 201, the expandable screens 213 may be similar to the expandable screens 203, and a coupling 215 may be similar to the coupling 205. In addition to the configuration described in FIG. 2A, the schematic diagram 210 may include a connection line 217 between screen joints. For example, a hydraulic line, electric line, fiber optic line, etc. may be used as the connection line 217 between the expandable screens 213. However, the connection line 217 is not limited to the above three examples. The connection line 217 may be conveyed through multiple screen sections and may extend to the surface.

Figure 2C:
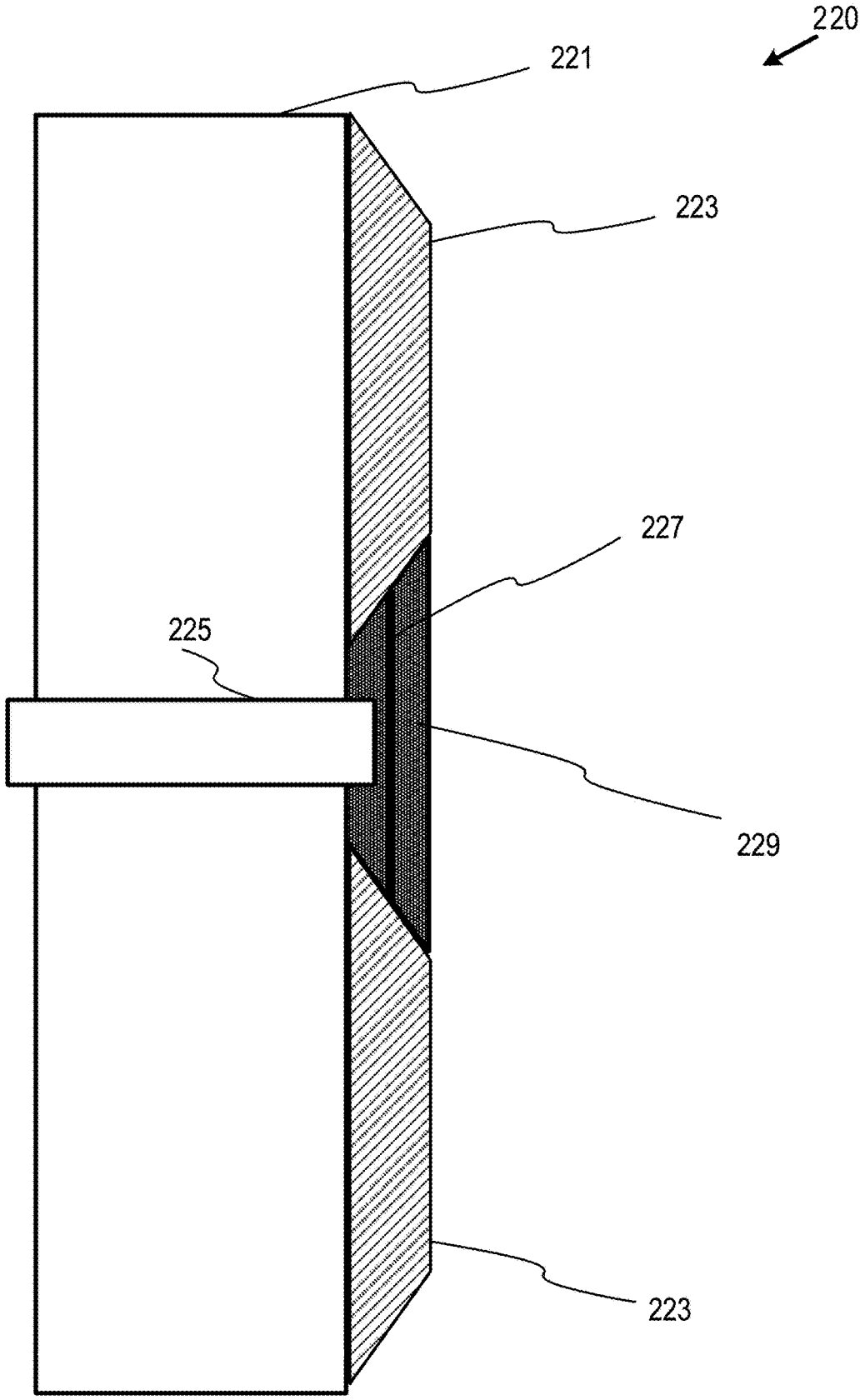
FIG. 2C is a third schematic diagram depicting an example tubing coupling between screen joints comprising a connection line and a clamshell packer, according to some implementations.

FIG. 2C is a third schematic diagram 220 depicting an example tubing coupling between screen joints comprising a connection line and a clamshell packer, according to some implementations. FIG. 2C may be described with reference to FIG. 2B. The schematic diagram 220 depicts a side-view of a tubing string 221. The tubing string 221 may be similar to the tubing string 211, the expandable screens 223 may be similar to the expandable screens 213, a coupling 225 may be similar to the coupling 215, and a connection line 227 may be similar to the connection line 217. The schematic diagram 220 further includes a clamshell-style ("clamshell") packer 229 secured around the tubing (base pipe, tubular, etc.) 221. The clamshell packer 229 may be installed at the surface around the tubing coupling 225 and the connection line 227. The clamshell packer 229 may comprise an outer diameter of an acceptable clearance to run into the wellbore with the expandable screens 223 in their retracted position.

Figure 3A:
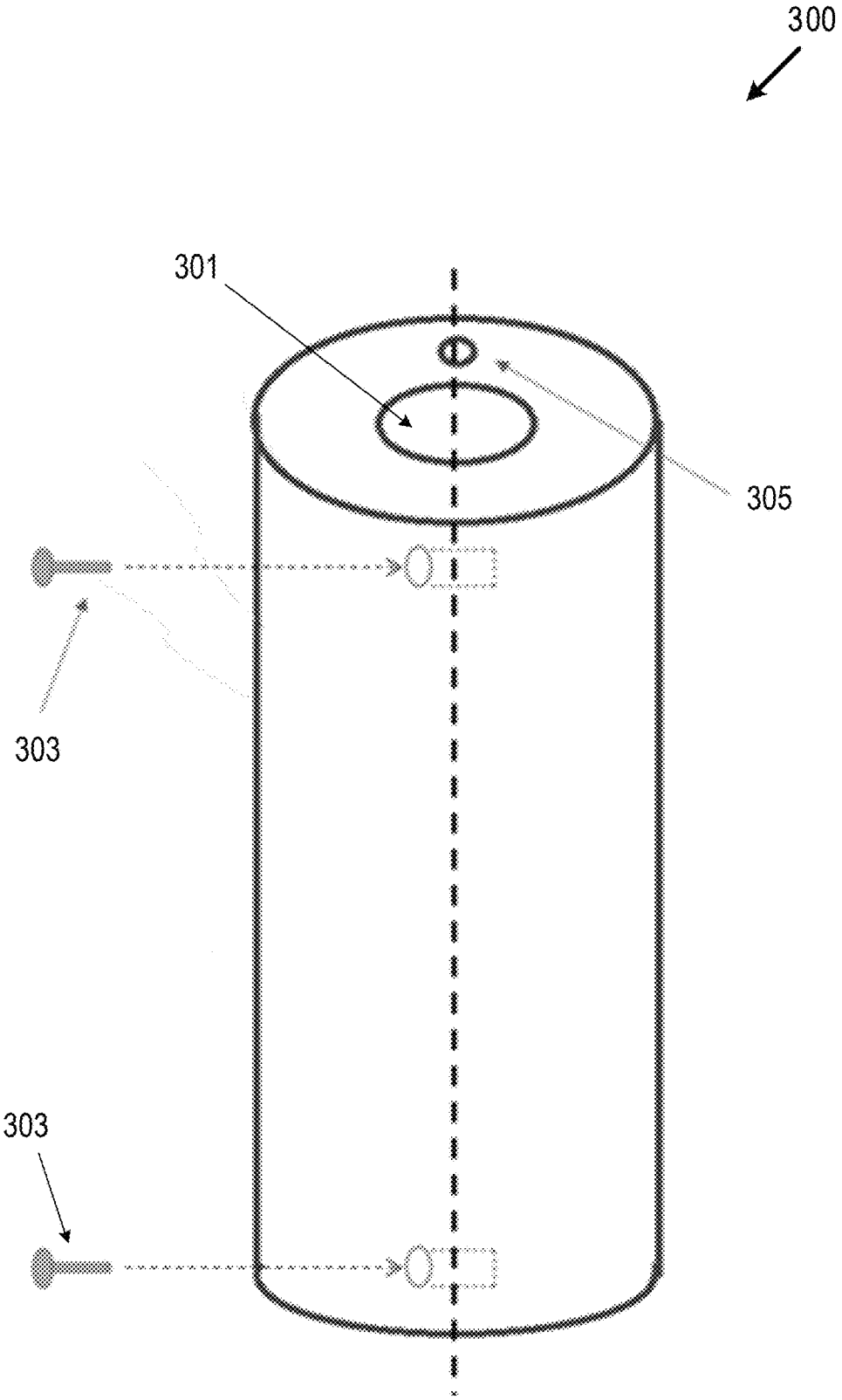
FIG. 3A is a schematic diagram depicting an example clamshell packer, according to some implementations.

FIG. 3A is a schematic diagram depicting an example clamshell packer, according to some implementations. FIG. 3A may be described with reference to FIG. 2C. A clamshell packer 300 may be comprised of two halves straddling a base pipe coupling via one or more bolts 303. In some implementations, the clamshell packer 300 may be secured around a coupling (or other non-compliant section between screens) via one or more straps. The clamshell packer 300 may also be configured to cover the blank handling space at box and pin ends of screen joints, which may be similar to the expandable screens 223. The clamshell packer may comprise a primary opening 301 which may be configured to house a portion of a tubing joint. The clamshell packer 300 may comprise a secondary opening 305 configured to house a connection line which may be similar to the connection line 217, 227. In some implementations, the clamshell packer 300 may be designed to allow flow tubes, shunt jumper tubes, or other lines to pass through the secondary opening 305.

In some implementations, the clamshell packer 300 may be comprised of a non-elastomeric, expandable (also referred to as swellable or reactive) metal or metal alloy configured to expand via a chemical reaction. For example, the clamshell packer 300 may be comprised of metals including, but not limited to, magnesium, calcium, aluminum, tin, zinc, beryllium, barium, manganese, or any combination thereof. Preferred metals may include magnesium, calcium, and aluminum. The metal may be configured to swell in the presence of a certain type of fluid, such as a brine.

In other implementations, the clamshell packer 300 may be comprised of expandable metal alloys including, but not limited to, alloys of magnesium, calcium, aluminum, tin, zinc, beryllium, barium, manganese, or any combination thereof. Preferred metal alloys may include alloys of magnesium-zinc, magnesium-aluminum, calcium-magnesium, or aluminum-copper. In some examples, the metal alloys may comprise alloyed elements that are not metallic. Examples of these non-metallic elements may include, but are not limited to, graphite, carbon, silicon, boron nitride, etc. In some implementations, the metal is alloyed to increase reactivity and/or to control oxide formation. In some implementations, the bolts 303 may be comprised of similar material to the clamshell packer 300, although in other implementations the bolts may be comprised of steel or other non-reactive materials.

In other implementations, the metal alloy used for the clamshell packer 300 may be alloyed with a dopant metal that promotes corrosion or inhibits passivation. The dopant metal may increase the formation of hydroxides when the clamshell packer 300 reacts with a wellbore fluid. Examples of dopant metals to be used for the clamshell packer 300 may include, but are not limited to, nickel, iron, copper, carbon, titanium, gallium, mercury, cobalt, iridium, gold, palladium, or any combination thereof.

Figure 3B:
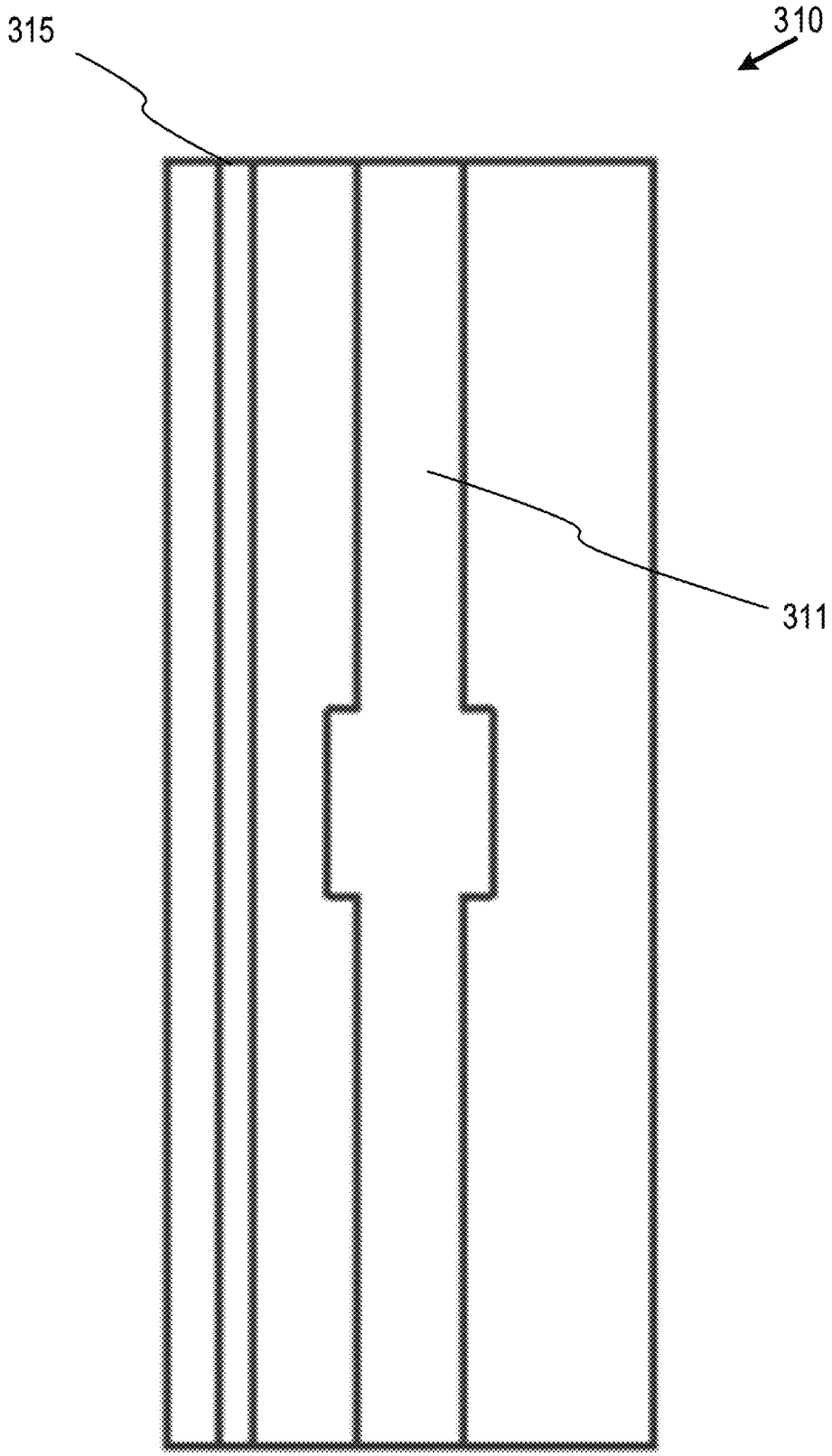
FIG. 3B is a cross-sectional diagram depicting a side view of the example clamshell packer, according to some implementations.

FIG. 3B is a cross-sectional diagram depicting a side view of the example clamshell packer, according to some implementations. FIG. 3B may be described with reference to FIG. 3A. A half clamshell 310 may comprise a primary opening 311 which may be similar to the primary opening 301 of FIG. 3A. The half clamshell 310 may also comprise a secondary opening 315 which may be similar to the secondary opening 305. The secondary opening 305 may be configured as a pass-through for a connection line such as the connection line 227.

Example Clamshell Packer Operation

Figure 4A:
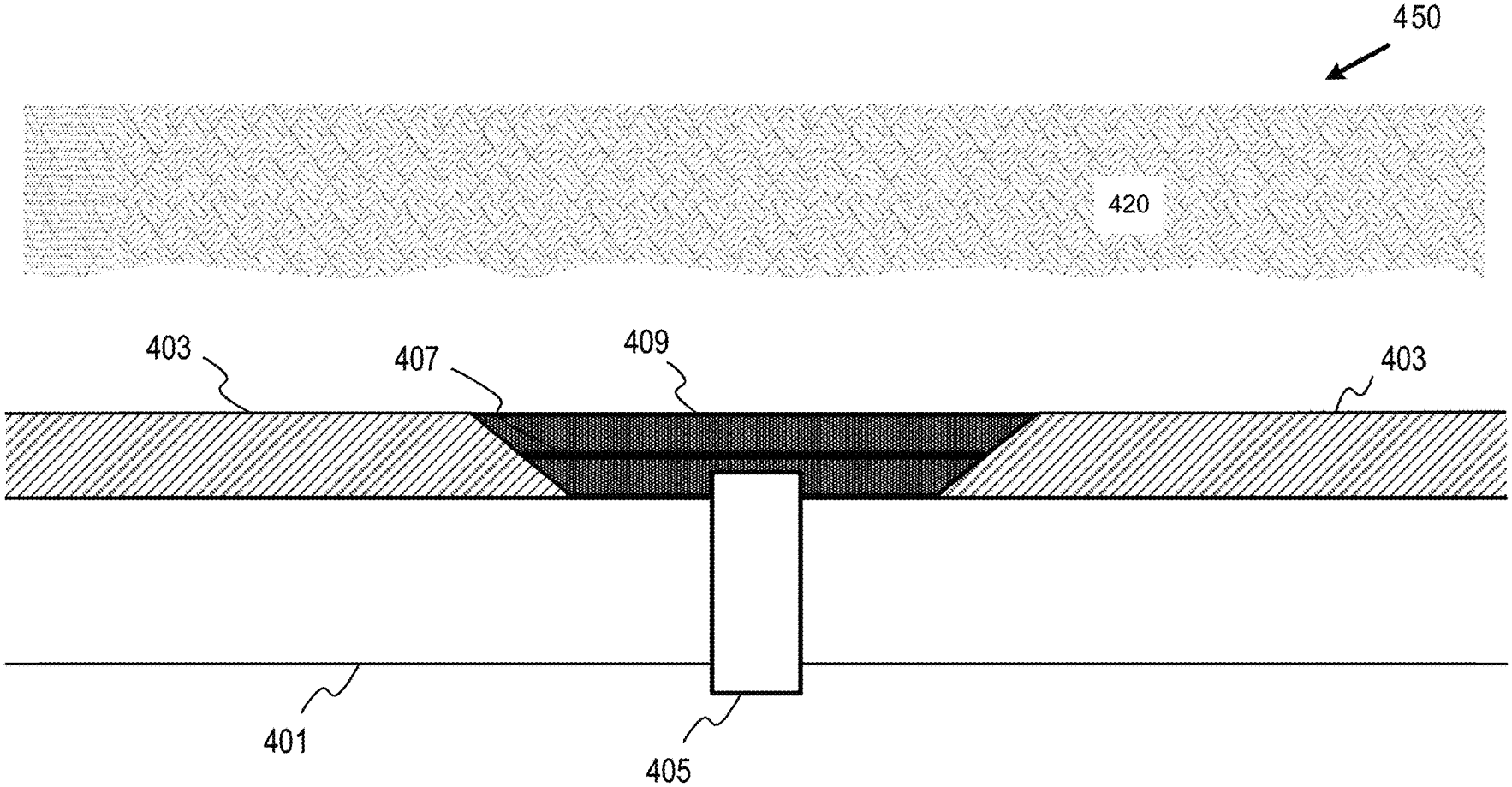
FIG. 4A is a first illustration depicting an example tubing string proximate to a subsurface formation, according to some implementations.

FIG. 4A is a first illustration depicting an example tubing string proximate to a subsurface formation, according to some implementations. A wellbore 450 may comprise a tubing string 401 proximate to a subsurface formation 420 at a target depth. The tubing string 401 may comprise a coupling 405 and expandable screens 403 disposed around the tubing string 401 and flanking the sides of a non-compliant area over the coupling 405. A clamshell packer 409 may be installed over the coupling 405 between the expandable screens 403. In some implementations, the expandable screens 403 may be expandable hydraulic screens. The clamshell packer 409 may allow a connection line 407 to pass through. The expandable screens 403 may be configured in a retracted position while being conveyed to a target site.

Figure 4B:
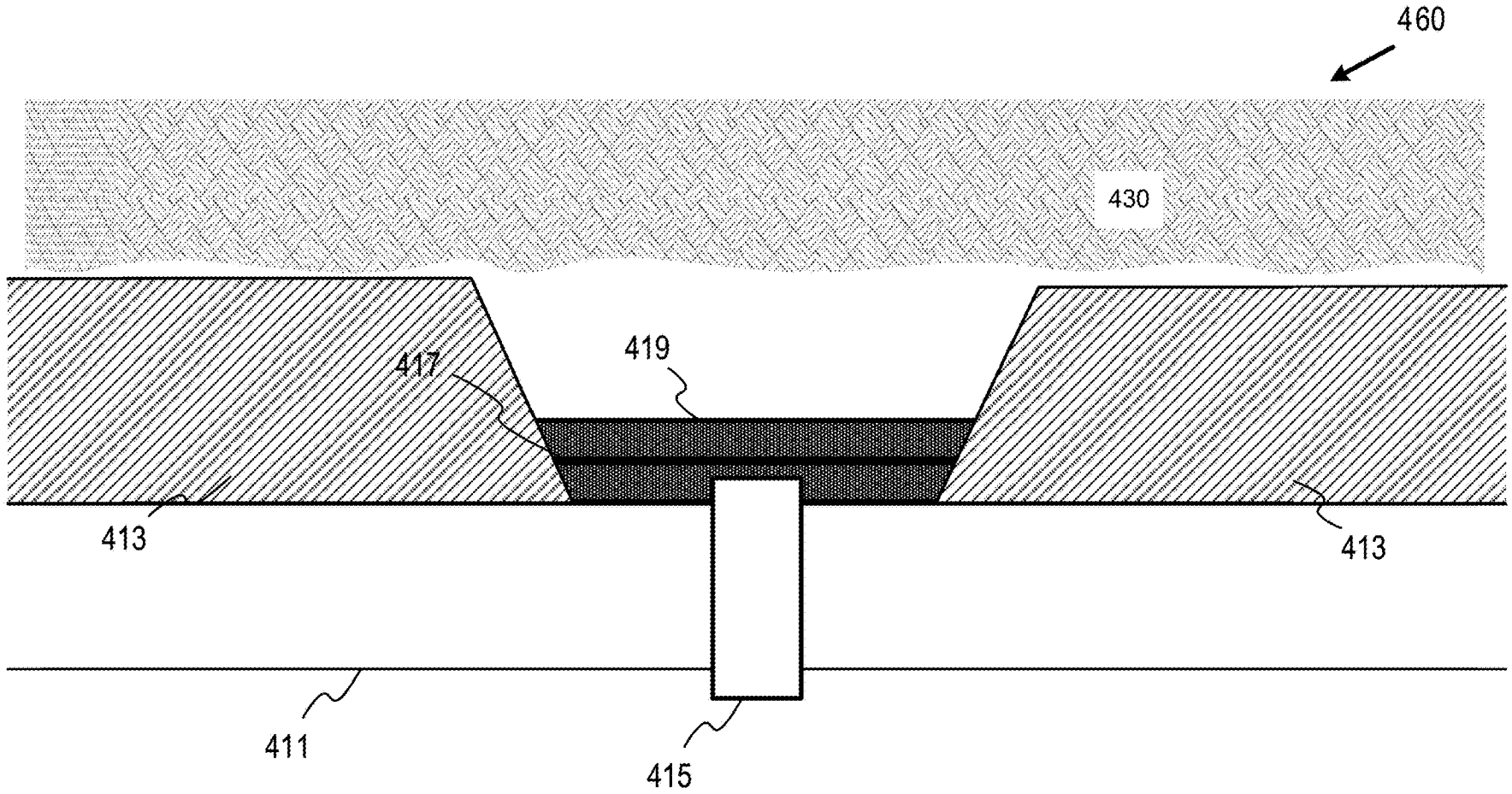
FIG. 4B is a second illustration depicting an example tubing string proximate to a subsurface formation, according to some implementations.

FIG. 4B is a second illustration depicting an example tubing string 411 proximate to a subsurface formation 430, according to some implementations. A wellbore 460 may comprise the tubing string 411, coupling 415, subsurface formation 430, connection line 417, and clamshell packer 419 may be similar to the tubing string 401, coupling 405, subsurface formation 420, connection line 407, and clamshell packer 409 of FIG. 4A. However, the expandable screens 413 of FIG. 4B are actuated to expand and make contact with the subsurface formation 430. A hydraulic pressure may be applied through the tubing string 411 to activate, for example, the expandable screens 413 to become compliant (in contact) with an open hole section of the subsurface formation 430. In some implementations, the expandable screens 413 may be expanded by pressurizing the tubing string 411. The tubing string 411 may comprise ports (not depicted) that allow fluid to expand the expandable screens 413. In other implementations, the connection line 417 may comprise a hydraulic line which may be used to supply pressure to subsequent expandable screens 413 along the tubing string 411. The clamshell packer 419 may also be actuated to expand to make contact with the subsurface formation 430, as further discussed in the description of FIG. 4C.

Figure 4C:
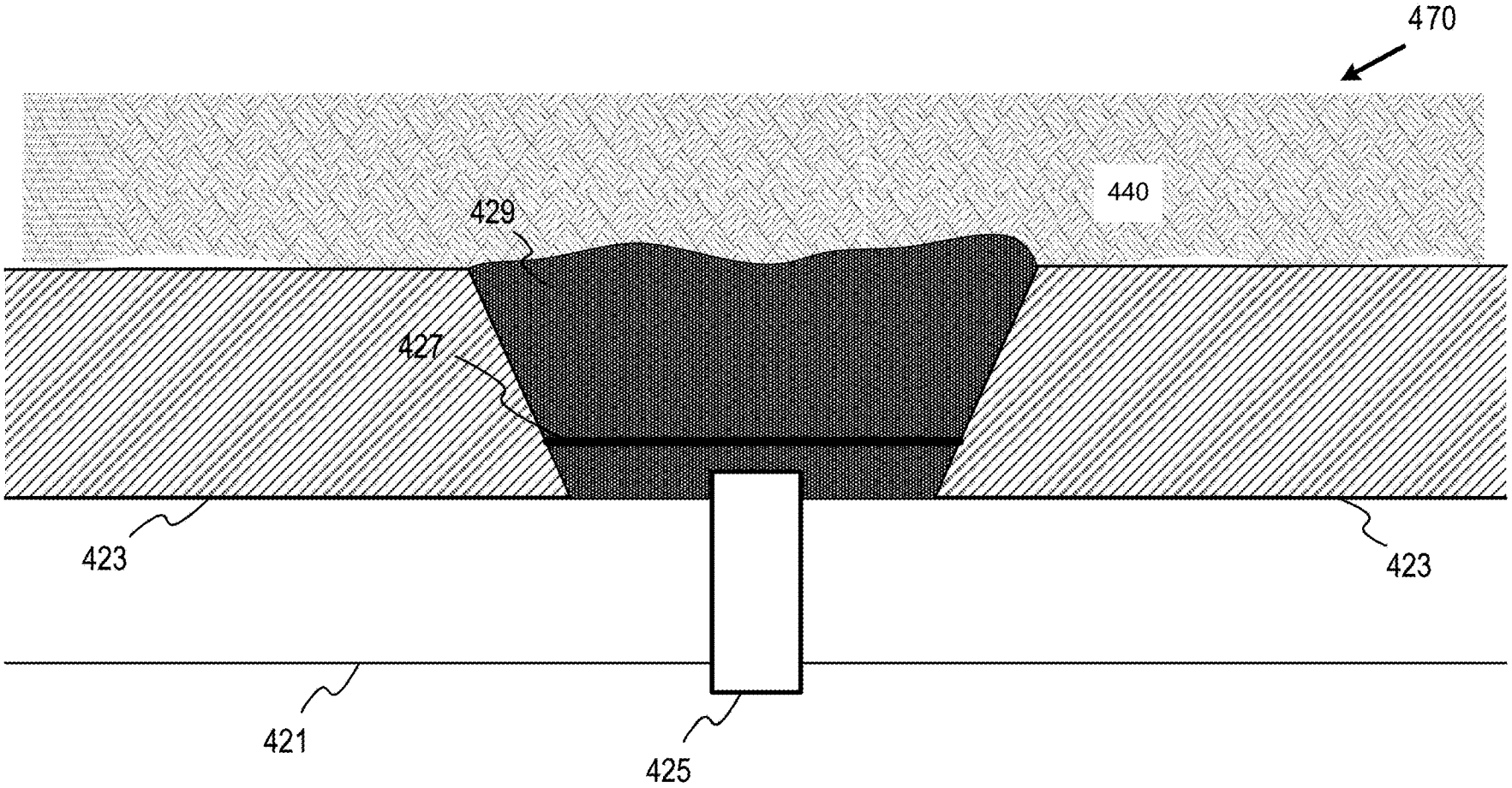
FIG. 4C is a third illustration depicting an example tubing string proximate to a subsurface formation, according to some implementations.

FIG. 4C is a third illustration depicting an example tubing string 421 proximate to a subsurface formation 440, according to some implementations. A wellbore 470 may comprise the tubing string 421, coupling 425, subsurface formation 440, connection line 427, and expandable screens 423 may be similar to the tubing string 411, coupling 415, subsurface formation 430, connection line 417, and expandable screens 413 of FIG. 4B. However, a clamshell packer 429 may be configured to swell and expand under certain conditions to make contact and form a seal against the subsurface formation 440. This swelling is achieved by the clamshell packer 429 increasing in volume. This increase in volume corresponds to an increase in the clamshell packer's annular volume. When expanded, the clamshell packer 429 may mitigate hot spotting and sand migration at edges of the expandable screens 423. In some implementations, the clamshell packer 429 may be comprised of similar materials to the clamshell packer 300. The clamshell packer 429 may be configured to swell and close the gaps in irregular surfaces such as an open hole wellbore drilled into the subsurface formation 440. For example, the clamshell packer 429 may be used to form a seal between any adjacent surfaces in the wellbore including, but not limited to, various conduits, formation surfaces, cement sheaths, downhole tools, etc. For example, the clamshell packer 429 may be configured to swell to form a seal between the outer diameter of a conduit such as the tubing string 421 and a surface of the subsurface formation 440. Alternatively, the clamshell packer 429 may be used to form a seal between the outer diameter of a conduit such as the tubing string 421 and a cement sheath (e.g., a casing). As another example, the clamshell packer 429 may be used to form a seal between the outer diameter of one conduit and the inner diameter of another conduit (which may be the same or different). A plurality of clamshell packers 429 may be used along multiple couplings 425 of a tubing string 421. In some implementations, the clamshell packer 429 may be configured to swell and anchor a lower completion system in place. The clamshell packer 429 may also create zonal isolation between expanded screen systems in an open hole wellbore. It is to be understood that the clamshell packer 429 may be used to form a seal between any adjacent surfaces in the wellbore and the disclosure is not to be limited to the explicit examples disclosed herein.

As described above, the clamshell packer 429 may be comprised of a reactive metal configured to react with a brine or similar saline solution. The brine may be selected as a wellbore fluid into which the clamshell packer 429 and tubing string 421 are conveyed. For example, the brine which reacts with the clamshell packer 429 may include, but is not limited to, saltwater (e.g., water containing one or more salts dissolved therein), saturated saltwater (e.g., saltwater produced from a subterranean formation), seawater, fresh water, or any combination thereof. Generally, the brine may be from any source. The brine may be a monovalent brine or a divalent brine. Suitable monovalent brines may include, for example, sodium chloride brines, sodium bromide brines, potassium chloride brines, potassium bromide brines, and the like. Suitable divalent brines may include, for example, magnesium chloride brines, calcium chloride brines, calcium bromide brines, and the like. In some implementations, the salinity of the brine may exceed 10%. One of ordinary skill in the art, with the benefit of this disclosure, should be readily able to select a brine for a chosen application.

In some implementations, the brine may be added to wellbore 470 to replace an initial wellbore fluid. For example, an oil-based mud (OBM) or similar unreactive wellbore fluid with the clamshell packer 429 may be used when conveying the tubing string 421 and clamshell packer 429 to a target depth or location. Once in place, the OBM may be displaced by reactive brine pumped into the wellbore 470, thus inducing swelling of the clamshell packer 429.

The clamshell packer 429, when expanded, may be comprised of non-elastomeric materials that do not possess elasticity, and therefore, irreversibly swell when contacted with a brine. Thus, once expanded, the clamshell packer 429 may not return to its original size or shape even after the brine is removed. In implementations comprising an elastomeric binder dispersed within the reactive material of the clamshell packer, the elastomeric binder may return to its original size or shape; however, any expandable metal dispersed therein would not.

In some implementations, the clamshell packer 429 may be coated with one or more layers of coatings to alter a reaction time with a brine downhole. Thus, the coatings may either hasten or slow a reaction rate of the expandable metal of which the clamshell packer 429 comprises. The clamshell packer 429 may reasonably reach full expansion (to create a scaling interface), without coatings or other alterations, within a range spanning a few hours to one month. The expandable screens 423, however, may expand to contact the subsurface formation 440 within minutes. While the clamshell packer 429 may take longer to reach full expansion and create a seal in the wellbore 470, completions operations (or other downhole operations) may not be delayed by the slower expansion. Erosion via abrasive invasion inflicts damage on timeframes spanning multiple months to years-thus, abrasion via sand ingress during the clamshell packer's expansion may not cause substantial operational distress to the expandable screens 423.

The expansion rate (reaction rate of the clamshell packer) may be altered via changes to the concentration of the selected brine, via the temperature proximate to the clamshell packer 429, and, as described above, various coatings used on the clamshell packer 429. In some implementations, a reaction rate of the clamshell packer 429 with a brine may be hastened by increasing a surface area of the clamshell packer 429. For example, slits or grooves may be cut into an outward-facing surface of the clamshell packer 429 that contacts the subsurface formation 440. Prior to making contact with the subsurface formation 440 and forming a seal, the clamshell packer 429 may be in contact with a reactive brine, and the slits/grooves may increase a surface area of the clamshell packer in contact with the brine, thus increasing the reaction rate between the clamshell packer and the brine.

To limit expansion during transit to a target location in the wellbore, the clamshell packer may comprise a coating layer with a variable corrosion rate when exposed to a wellbore fluid, thus acting as a delay trigger that postpones the reaction of the expandable metal/alloy. Thus, the coating may delay hydrolyzation of the clamshell packer 429 until a predetermined amount of time has lapsed. As the coating layer is compromised, the expandable material underneath may expand to create a seal. This delay provides time to deploy and position the clamshell packer 429 to a target location within the wellbore.

In other implementations, a temperature of the wellbore fluid may be used to hasten or delay the expansion of the clamshell packer 429. For example, the chemical reaction of the clamshell packer 429 with the wellbore fluid may be delayed by flowing fluid through an annulus of the wellbore 470 during expansion of the clamshell packer 429. The flow of fluid over the clamshell packer 429 may decrease the temperature in the wellbore, thus slowing the chemical reaction (and therefore expansion) of the clamshell packer 429. In other implementations, the reaction may be hastened by shutting in the wellbore or otherwise halting fluid flow, thereby increasing a downhole temperature in the wellbore 470.

The coating on the clamshell packer 429 may be configured to react with a wellbore fluid (such as a brine) and corrode within a predetermined amount of time to allow the wellbore fluid to contact and hydrolyze the clamshell packer 429. It is understood that given enough time, many types of materials have a natural rate of corrosion when exposed to a wellbore fluid environment. However, as used herein, "a predetermined amount of time" means a period of time that is less than a natural rate of corrosion and is one where the selection and/or application of the coating to the clamshell packer 429 is made to provide a coating layer that corrodes within a selected period of time during which a well completion, workover, or other operation is completed. For example, the predetermined amount of time may range from several hours up to two months. The amount of time delay in corrosion may be based on one or more physical characteristics of the material comprising the coating layer. For example, the corrosion rate may be based on the permeability of the coating, the type of material(s) used in the coating layer, the porosity of the coating, or any combination thereof. In some implementations, the clamshell packer 429 may comprise multiple coatings of different materials, as explained in further detail below.

In some implementations, the clamshell packer 429 may comprise a coating composed of a metal, a ceramic, an organic compound, a polymer, or any combination thereof. In implementations where the coating is a metal, the metal may comprise nickel, gold, silver, titanium, chrome, or a combination thereof. Example ceramic coatings for use on the clamshell packer 429 may comprise zirconium dioxide or other ceramic materials having similar properties. Example organic coatings may include sorbitan monooleate, glycerin monoricinoleate, sorbitan monoricinoleate, sorbitanmonotallate, pentaerythritol monoricinoleate, sorbitan monoisostearate, glycerol monostearate, sorbitan monostearate, or mixtures thereof. In other implementations, a strike or flash, which is a known plating technique, may initially be placed on the reactive metal comprising the clamshell packer 429. This plating layer forms a strong bond to the base metal and may allow for thicker layers of coating(s) to be quickly applied.

As mentioned above, the clamshell packer 429 may be coated with one or more polymers. For example, a polymer coating on the clamshell packer 429 may be comprised of rubber, epoxy, plastics, such as polylactic acid, poly (glycolic acid), low density polyethylene, high density polyethylene, polypropylene, or urethane plastic. In some implementations, the polymer comprises a relatively high crystalline polymer that is substantially impermeable to wellbore fluid at lower temperatures. However, at elevated temperatures, the polymer may become substantially permeable to a wellbore fluid when heated to a crystallization temperature of the polymer. In some implementations, the clamshell packer 429 may comprise a polymer coating with a permeability that changes with time. In such implementations, increasing amounts of wellbore fluid (water, brine, etc.) may enter, resulting in hastened destruction of the barrier coating layer. Thus, a more rapid transition from "no expansion" to "rapid expansion" of the clamshell packer 429 may be achieved.

The connection line 427 may include, but is not limited to, a hydraulic line, an electric line, or a fiber optic cable. The connection line 427 may, in some implementations, be used to verify that the clamshell packer 429 has expanded. For example, to verify that the clamshell packer 429 has expanded to fill a void in the wellbore 470, the connection line 427 may comprise a fiber optic cable coupled to a computer at the surface and configured to perform distributed temperature sensing (DTS) along the tubing string 421.

The clamshell packer 429 may produce a substantial amount of heat when reacting with a brine in the wellbore 470, and this heat may be sensed by a DTS system. In other implementations, the connection line 427 may utilize an electric line. The electric line may apply a voltage to the clamshell packer 429 via a downhole power generation source or via a surface power unit to induce galvanic corrosion of the clamshell packer 429, thus increasing its rate of expansion.

Example Flowchart

Figure 5:
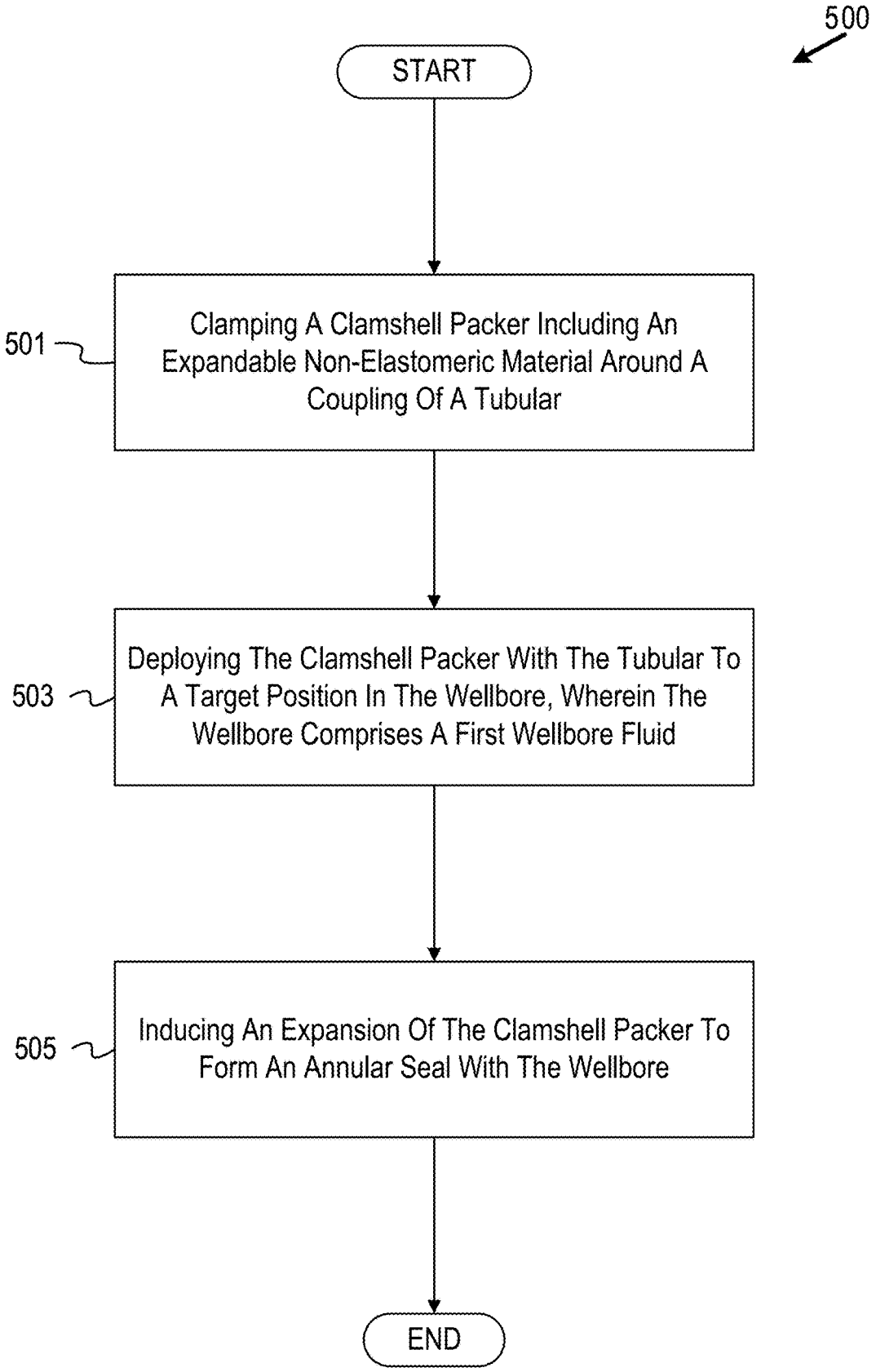
FIG. 5 is a flowchart depicting example operations for use of the clamshell packer, according to some implementations.

FIG. 5 is a flowchart depicting example operations for use of the clamshell packer, according to some implementations. Operations of a method 500 may be performed in part by software, firmware, hardware, or a combination thereof. Such operations are described with reference to FIGS. 1-4. However, such operations may be performed by other systems or components. The operations of the method 500 begin at block 501.

At block 501, the method 500 includes clamping the clamshell packer 229 around a coupling 225 of the tubing string (or similar tubular) 221. This may be done at the surface by a rig crew or other on-site personnel. The clamshell packer's design may be configured to clamp over the coupling 225 and a handling space on the tubular used by the rig crew to create a threaded connection between the two joints of pipe. Flow progresses to block 503.

At block 503, the method 500 includes deploying the clamshell packer 409 with the tubular (tubing string) 401 to a target position in the wellbore 450, wherein the wellbore comprises a first wellbore fluid. In some implementations, the wellbore fluid may comprise a brine configured to chemically react with the clamshell packer 409. In other implementations, the wellbore 450 may comprise a wellbore fluid that is non-reactive with the clamshell packer 429. Thus, to induce an expansion of the clamshell packer to form an annular seal within the wellbore 450, the non-reactive fluid (e.g., oil-based mud) may be displaced by a brine solution pumped downhole. Flow progresses to block 505.

As block 505, the method 400 includes inducing an expansion of the clamshell packer 429 to form an annular seal with the wellbore 470. In some implementations, this expansion may be hastened by increasing a surface area of the clamshell packer 429, increasing a salinity of the wellbore fluid, increasing a downhole temperature of the wellbore 470, supplying power to the clamshell packer 429 to induce galvanic corrosion, etc. Flow of the method 500 ceases.

EXAMPLE IMPLEMENTATIONS

Implementation 1: A clamshell packer for use in a wellbore proximate to a subsurface formation, the clamshell packer comprising: an expandable non-elastomeric material and configured to annularly envelop a non-compliant portion of a tubular in the wellbore, the non-compliant portion between one or more expandable screens.

Implementation 2: The clamshell packer of Implementation 1, wherein the clamshell packer comprises a first sealing element and a second sealing element, wherein the second sealing element is configured to couple to the first sealing element to form the clamshell packer.

Implementation 3: The clamshell packer of any one or more of Implementations 1-2, wherein the clamshell packer is configured to expand and form a sealing interface with the wellbore via a chemical reaction with a reactive wellbore fluid in the wellbore, wherein the reactive wellbore fluid is a brine.

Implementation 4: The clamshell packer of any one or more of Implementations 1-3, wherein the expandable non-elastomeric material comprises one of an expandable metal and an expandable metal alloy configured to react with the reactive wellbore fluid.

Implementation 5: The clamshell packer of any one or more of Implementations 1-4, wherein the clamshell packer includes one or more layers of coating, wherein the one or more layers of coating are configured to alter a reaction rate of the chemical reaction.

Implementation 6: The clamshell packer of any one or more of Implementations 1-5, wherein the clamshell packer comprises one or more grooves, wherein the one or more grooves are configured to increase a surface area of the clamshell packer, and wherein the increased surface area increases a reaction rate with the reactive wellbore fluid.

Implementation 7: An annular sealing system for use in a wellbore proximate to a subsurface formation comprising: a tubular; one or more expandable screens coupled to the tubular; and a clamshell packer including an expandable non-elastomeric material and configured to annularly envelop a non-compliant portion of the tubular between the one or more expandable screens.

Implementation 8: The annular sealing system of Implementation 7, wherein the clamshell packer comprises a first sealing element and a second sealing element, wherein the second sealing element is configured to couple to the first sealing element to form the clamshell packer.

Implementation 9: The annular sealing system of any one or more of Implementations 7-8, wherein the clamshell packer is configured to expand and form a sealing interface with the wellbore via a chemical reaction with a reactive wellbore fluid in the wellbore, wherein the reactive wellbore fluid is a brine.

Implementation 10: The annular sealing system of any one or more of Implementations 7-9, wherein the expandable non-elastomeric material comprises one of an expandable metal and an expandable metal alloy configured to react with the reactive wellbore fluid.

Implementation 11: The annular sealing system of any one or more of Implementations 7-10, wherein the clamshell packer includes one or more layers of coating, wherein the one or more layers of coating are configured to alter a reaction rate of the chemical reaction.

Implementation 12: The annular sealing system of any one or more of Implementations 7-11, wherein the non-compliant portion of the tubular includes a base pipe coupling.

Implementation 13: The annular sealing system of any one or more of Implementations 7-12, further comprising a connection line configured to pass through an opening in the clamshell packer, wherein the connection line is one of a hydraulic line, an electrical line, and a fiber optic cable.

Implementation 14: The annular sealing system of any one or more of Implementations 7-13, wherein the clamshell packer comprises one or more grooves, wherein the one or more grooves are configured to increase a surface area of the clamshell packer, and wherein the increased surface area increases a reaction rate with the reactive wellbore fluid.

Implementation 15: A method for deploying a sealing apparatus into a wellbore formed in a subsurface formation, the method comprising: clamping a clamshell packer including an expandable non-elastomeric material around a coupling of a tubular; deploying the clamshell packer with the tubular to a target position in the wellbore, wherein the wellbore comprises a first wellbore fluid; and inducing an expansion of the clamshell packer to form an annular seal with the wellbore.

Implementation 16: The method of Implementation 15, further comprising: displacing the first wellbore fluid with a second, more reactive wellbore fluid configured to react with the expandable non-elastomeric material of the clamshell packer, wherein the second wellbore fluid is a brine, and the expansion of the clamshell packer is in induced in presence of the second wellbore fluid.

Implementation 17: The method of any one or more of Implementations 15-16, further comprising: coating the clamshell packer with one or more layers of coating, wherein the one or more layers of coating are configured to alter a reaction rate of a chemical reaction between the clamshell packer and the first wellbore fluid.

Implementation 18: The method of any one or more of Implementations 15-17, wherein clamping the clamshell packer around the coupling of the tubular comprises clamping the clamshell packer between one or more expandable screens disposed along the tubular.

Implementation 19: The method of any one or more of Implementations 15-18, further comprising: forming a plurality of grooves in a surface of the clamshell packer to increase its surface area, wherein increasing the surface area increases the reaction rate of the chemical reaction between the clamshell packer and the first wellbore fluid.

Implementation 20: The method of any one or more of Implementations 15-19, further comprising: verifying the clamshell packer has expanded via a fiber optic cable configured to pass through an opening in the clamshell packer, wherein the fiber optic cable is configured to detect a temperature of the clamshell packer during the chemical reaction.

What is claimed is:

1. An apparatus comprising:

a clamshell packer configured to clamp around a coupling between a first tubular and a second tubular of a tubing string to be positioned in a wellbore proximate to a subsurface formation, wherein the clamshell packer includes, an expandable non-elastomeric material, a first portion having a first inner diameter configured to clamp around the first and second tubulars, and a second portion having a second, larger inner diameter configured to clamp around the coupling.

2. The apparatus of claim 1, wherein the clamshell packer comprises a first sealing element and a second sealing element, wherein the second sealing element is configured to couple to the first sealing element to form the clamshell packer.

3. The apparatus of claim 1, wherein the clamshell packer is configured to annularly envelop a region of the tubing string between one or more expandable screens, wherein the clamshell packer is configured to expand and form a sealing interface with the wellbore via a chemical reaction with a reactive wellbore fluid in the wellbore, and wherein the reactive wellbore fluid is a brine.

4. The apparatus of claim 3, wherein the expandable non-elastomeric material comprises one of an expandable metal and an expandable metal alloy configured to react with the reactive wellbore fluid.

5. The apparatus of claim 3, wherein the clamshell packer includes one or more layers of coating, wherein the one or more layers of coating are configured to alter a reaction rate of the chemical reaction.

6. The apparatus of claim 3, wherein the clamshell packer comprises one or more grooves, wherein the one or more grooves are configured to increase a surface area of the clamshell packer, and wherein the increased surface area increases a reaction rate with the reactive wellbore fluid.

7. An annular sealing system for use in a wellbore proximate to a subsurface formation comprising:

a tubing string including at least a first tubular and a second tubular;

one or more expandable screens coupled to the tubing string; and a clamshell packer configured to clamp over a coupling between the first tubular and the second tubular of the tubing string, wherein the clamshell packer includes, an expandable non-elastomeric material, a first portion having first inner diameter configured to clamp around the first and second tubulars, and a second portion having a second, larger inner diameter configured to clamp around the coupling.

8. The annular sealing system of claim 7, wherein the clamshell packer comprises a first sealing element and a second sealing element, wherein the second sealing element is configured to couple to the first sealing element to form the clamshell packer.

9. The annular sealing system of claim 7, wherein the clamshell packer is configured to annularly envelop a region of the tubing string between the one or more expandable screens, wherein the clamshell packer is configured to expand and form a sealing interface with the wellbore via a chemical reaction with a reactive wellbore fluid in the wellbore, and wherein the reactive wellbore fluid is a brine.

10. The annular sealing system of claim 9, wherein the expandable non-elastomeric material comprises one of an expandable metal and an expandable metal alloy configured to react with the reactive wellbore fluid.

11. The annular sealing system of claim 9, wherein the clamshell packer includes one or more layers of coating, wherein the one or more layers of coating are configured to alter a reaction rate of the chemical reaction.

12. The annular sealing system of claim 9, wherein the region of the tubing string includes the coupling.

13. The annular sealing system of claim 9, wherein the clamshell packer comprises one or more grooves, wherein the one or more grooves are configured to increase a surface area of the clamshell packer, and wherein the increased surface area increases a reaction rate with the reactive wellbore fluid.

14. The annular sealing system of claim 7, further comprising a connection line configured to pass through an opening in the clamshell packer, wherein the connection line is one of a hydraulic line, an electrical line, and a fiber optic cable.

15. A method for deploying a sealing apparatus into a wellbore formed in a subsurface formation, the method comprising:

clamping a clamshell packer around a coupling between a first tubular and a second tubular of a tubing string, wherein the clamshell packer includes an expandable non-elastomeric material, wherein a first portion of the clamshell packer includes a first inner diameter configured to clamp around the first and second tubulars, and wherein a second portion of the clamshell packer includes a second, larger inner diameter configured to clamp around the coupling;

deploying the clamshell packer with the tubing string to a target position in the wellbore, wherein the wellbore comprises a first wellbore fluid; and inducing an expansion of the clamshell packer to form an annular seal with the wellbore.

16. The method of claim 15, further comprising:

displacing the first wellbore fluid with a second, more reactive wellbore fluid configured to react with the expandable non-elastomeric material of the clamshell packer, wherein the second wellbore fluid is a brine, and the expansion of the clamshell packer is in induced in presence of the second wellbore fluid.

17. The method of claim 15, further comprising:

coating the clamshell packer with one or more layers of coating, wherein the one or more layers of coating are configured to alter a reaction rate of a chemical reaction between the clamshell packer and the first wellbore fluid.

18. The method of claim 17, further comprising:

forming a plurality of grooves in a surface of the clamshell packer to increase its surface area, wherein increasing the surface area increases the reaction rate of the chemical reaction between the clamshell packer and the first wellbore fluid.

19. The method of claim 17, further comprising:

verifying the clamshell packer has expanded via a fiber optic cable configured to pass through an opening in the clamshell packer, wherein the fiber optic cable is configured to detect a temperature of the clamshell packer during the chemical reaction.

20. The method of claim 15, wherein clamping the clamshell packer around the coupling of the tubing string comprises clamping the clamshell packer between one or more expandable screens disposed along the tubing string, wherein the clamshell packer is configured to annularly envelop a region of the tubing string between the one or more expandable screens.

* * * * *